US007578348B2

(12) United States Patent
Fay

(10) Patent No.: US 7,578,348 B2
(45) Date of Patent: Aug. 25, 2009

(54) OVERSHOT TOOL FOR RETRIEVING AN OBJECT IN A WELL AND METHODS OF USE THEREFOR

(75) Inventor: Peter J. Fay, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 218 days.

(21) Appl. No.: 11/524,106

(22) Filed: Sep. 20, 2006

(65) Prior Publication Data

US 2008/0066914 A1 Mar. 20, 2008

(51) Int. Cl.
*E21B 31/00* (2006.01)

(52) U.S. Cl. ..... 166/301; 166/98; 166/99; 294/86.26

(58) Field of Classification Search ..... 166/301, 166/98, 99; 294/86.26, 86.3
See application file for complete search history.

(56) References Cited

U.S. PATENT DOCUMENTS 1,754,696 A * 4/1930 Sauls ..... 294/86.33
1,797,505 A * 3/1931 Jones et al. ..... 294/86.33
2,272,529 A * 2/1942 Larson ..... 294/86.33
5,887,925 A * 3/1999 Arterbury et al. ..... 294/86.34

* cited by examiner

*Primary Examiner*—Jennifer H Gay
*Assistant Examiner*—Elizabeth C Gottlieb
(74) *Attorney, Agent, or Firm*—Greenberg Traurig LLP; Anthony F. Matheny

(57) ABSTRACT

An overshot tool for retrieving an object in a well includes a housing having a housing bore with upper and lower portions. A cam having a cam bore is carried in the upper portion of the bore. The housing and the cam are rotatable relative to each other from an aligned position, in which the cam bore axis and the housing bore lower portion axis coincide, to a misaligned position, in which the cam bore axis and the housing bore lower portion axis are misaligned with each other. The housing bore and the cam bore are open at a lower end for sliding over an object in the well when the tool is in the aligned position. Rotation of the housing and the cam relative to each other causes the cam bore axis and the lower portion axis to move toward the misaligned position, thereby gripping the object for retrieval.

20 Claims, 4 Drawing Sheets

OVERSHOT TOOL FOR RETRIEVING AN OBJECT IN A WELL AND METHODS OF USE THEREFOR

BACKGROUND

1. Field of Invention

The invention is directed to tools for retrieving an object disposed in the bore of a well, and in particular, to overshot fishing tools.

2. Description of Art

It is common for objects, such as a segment of a pipe, to become stuck or forcibly lodged within a wellbore. Tools for retrieving an object disposed in the bore of well are well known. These tools are known in the art as fishing tools. One type of fishing tool is known as an overshot fishing tool because the tool encases the object, or fish, disposed within the bore of the well. Such overshot fishing tools are known in the art; however, most of these known overshot fishing tools cannot retrieve a wide range of different sized fish. Currently, most known overshot fishing tools cannot retrieve fish having a variation in size of more than 0.06 inch.

Accordingly, overshot fishing tools capable of retrieving a wide range of different sized fish, and methods of retrieving an object disposed in the bore of a well using these overshot fishing tools have been desired in the art. As discussed herein, the overshot fishing tools and methods of retrieving an object disposed in the bore of a well using the overshot fishing tools disclosed herein effectively and efficiently retrieve objects disposed in the bore of a well. Additionally, the overshot fishing tools disclosed herein are easier to manufacture compared to other prior overshot fishing tools.

SUMMARY OF INVENTION

Broadly, the invention is directed to an overshot tool having a cam rotatably disposed within the bore of a housing. The housing includes an upper housing axis and a lower housing axis. Preferably, the upper housing axis is not aligned with the lower housing axis. The cam includes a bore having a cam axis. The cam axis can be rotated into and out of alignment with the lower housing axis. In operation, the overshot tool is lowered into a well with the cam axis aligned with the lower housing axis. The overshot tool is disposed over a fish within the well such that the fish is placed within the housing bore and the cam bore. The cam is then rotated relative to the housing such that the cam axis is moved out of alignment with the lower housing axis. As a result, the overshot tool grips or secures the fish and the overshot tool, together with the fish, can be removed from the well, thus, retrieving the fish from the well.

In accordance with one aspect of the invention, the foregoing advantages have been achieved through an overshot tool for retrieving an object in a well. The tool may comprise a housing having an upper end for attaching to a string for lowering the tool into the well, a housing bore having upper and lower portions, the lower portion having a lower portion axis; a cam carried in the upper portion of the bore, the cam having a cam bore that has a cam bore axis, the housing and the cam being rotatable relative to each other from an aligned position wherein the cam bore axis and the lower portion axis coincide to a misaligned position wherein the cam bore axis and the lower portion axis are offset and parallel to each other; and the lower portion of the housing bore and the cam bore being open at a lower end of the housing for sliding over an object in the well while the cam bore axis and lower portion axis are in the align position, so that subsequent rotation of the housing and the cam relative to each other causes the cam bore axis and the lower portion axis to move toward the misaligned position, thereby gripping the object for retrieval.

A further feature of the tool is that the upper portion of the housing bore may have an inner diameter that is greater than the lower portion of the housing bore. Another feature of the tool is that the lower portion axis may be offset and parallel to an upper portion axis of the upper portion of the housing bore. An additional feature of the tool is that the cam bore may include an upper portion that is concentric with the upper portion of the housing bore. Still another feature of the tool is that the lower portion of the housing bore and the cam bore may have cylindrical inner diameters. A further feature of the tool is that the lower portion of the bore may have an inner diameter that is substantially equal to an inner diameter of the cam bore. Another feature of the tool is that the upper portion of the bore of the housing may have an upper portion axis, the lower portion axis may be offset and parallel to the upper portion axis, and the cam bore axis may be offset and parallel to the upper portion axis in both the aligned and misaligned positions. An additional feature of the tool is that, in the misaligned position, the cam bore axis may be spaced on a side of the upper portion axis that is 180 degrees from the lower portion axis. Still another feature of the tool is that the portion of the housing containing the lower portion of the bore may have a cylindrical exterior and a wall thickness that varies from a minimum thickness on one side to a maximum thickness on an opposite side. A further feature of the tool is that the cam bore may have an upper portion that is concentric with the upper portion of the bore of the housing.

In accordance with another aspect of the invention, the foregoing advantages also have been achieved through an overshot tool that may comprise a housing having a string connection end, an open end, and a housing bore disposed longitudinally through the housing and in fluid communication with the open end, the housing bore having an upper concentric portion, a lower eccentric portion having a bore eccentric portion inner diameter, and a shoulder delineating the upper concentric portion from the lower eccentric portion; and a rotatable cam disposed within the upper concentric portion of the housing bore and contacting the shoulder, the cam having an attachment end, a lower open end, and a cam bore disposed longitudinally through the cam, the cam bore having an eccentric cam bore portion having a cam bore eccentric portion inner diameter, wherein the housing bore eccentric portion inner diameter is equal to the cam bore eccentric portion inner diameter.

A further feature of the tool is that the upper concentric portion of the bore may have a concentric inner diameter, the lower eccentric portion of the bore may have an eccentric inner diameter, and the concentric inner diameter may be greater than the eccentric inner diameter. Another feature of the tool is that the eccentric cam bore portion may be cylindrical and surrounded by an exterior portion of the cam that is cylindrical but offset relative to the eccentric cam bore portion. An additional feature of the tool is that the cam bore may further include a concentric cam bore portion. Still another feature of the tool is that the concentric cam bore portion may be disposed above the eccentric cam bore portion. A further feature of the tool is that rotating the cam relative to the housing may cause the eccentric cam bore portion to move from aligned to misaligned positions with the lower eccentric portion of the housing bore. Another feature of the tool is that the concentric cam bore portion may include a concentric cam bore inner diameter, the eccentric cam bore portion may include an eccentric cam bore inner diameter, and the concentric cam bore inner diameter may be less than the eccentric cam bore inner diameter.

In accordance with an additional aspect of the invention, the foregoing advantages also have been achieved through a method of retrieving a fish disposed in a bore of a well. The method may comprise the steps of (a) running an overshot tool into a well, the overshot tool comprising a cam carried within a housing, each having a bore portion with an axis, the cam and the housing being rotatable relative to each other from an aligned position wherein axes of the bore positions coincide to a misaligned position wherein the axes of the bore portions are parallel and offset from each other; (b) lowering the cam bore portion and housing bore portion over the fish while the cam bore portion and housing bore portion are in the aligned position; (c) rotating the cam and the housing relative to each other to move the bore portions toward the misaligned position to secure the fish within the bore portions; then (d) removing the overshot tool and the fish from the bore of the well.

A further feature of the method is that the cam and the housing may be rotated at least 60 degrees relative to each other between the aligned and the misaligned positions. Another feature of the method is that the cam and the housing may be rotated at least 120 degrees relative to each other between the aligned and the misaligned positions.

The overshot tools and methods of retrieving an object in a well have the advantages of providing effective and efficient retrieval of objects disposed within a well. Additionally, the overshot fishing tools disclosed herein are easier to manufacture compared to other prior overshot fishing tools.

Figure 1A:
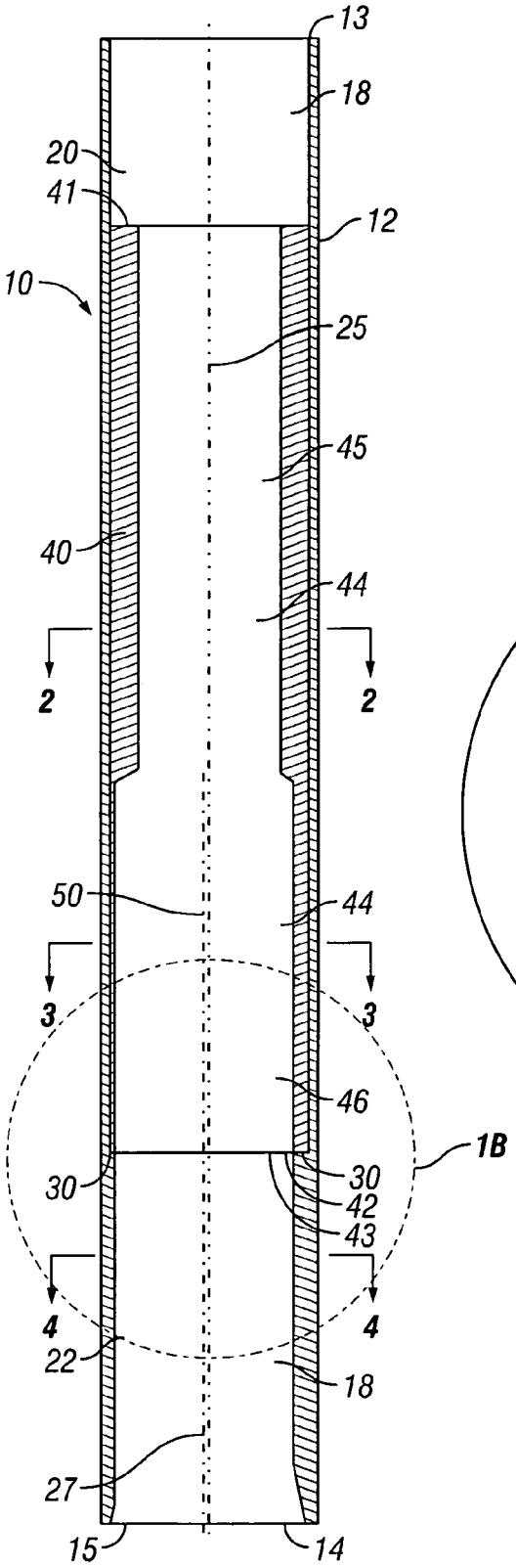
FIG. 1 is a vertical cross-sectional view of a specific embodiment of an overshot tool shown in its unset position.

While the invention will be described in connection with the preferred embodiments, it will be understood that it is not intended to limit the invention to those embodiments. On the contrary, it is intended to cover all alternatives, modifications, and equivalents, as may be included within the spirit and scope of the invention as defined by the appended claims.

DETAILED DESCRIPTION OF INVENTION

Referring to FIGS. 1-4, overshot tool 10 is shown in its unset position, i.e., the position at which overshot tool 10 is run or lowered into a well prior to securing the fish (not shown). Overshot tool 10 includes cylindrical housing 12 having upper end 13 having threads (not shown) or other structure to facilitate attaching upper end 13 to a string of conduit, such as drill pipe or coiled tubing, for lowering or running overshot tool 10 into a well, for raising or removing overshot tool 10 from the well, and, in one particular embodiment, for rotating housing 12. Housing 12 is a tubular member, preferably having a cylindrical outer diameter.

Overshot tool 10 also includes lower end 14 having opening 15 of housing bore 18. Housing bore 18 has a lower portion 22 that is cylindrical but offset or eccentric relative to the cylindrical outer diameter of housing 12. Preferably, opening 15 is conical or flared. Because bore 18 is offset, flared opening portion 15 has a height that varies from a minimum on one point, shown on the left side of FIG. 1, to a maximum 180 degrees away from the minimum point. Flared opening 15 facilitates entry of a fish (not shown) into housing bore 18, which is in fluid communication with opening 15. Similarly, because of the offset of bore lower portion 22 relative to the outer diameter of housing 12, the housing wall thickness at lower end 14 varies from a minimum at one point to a maximum 180 degrees away.

Housing bore 18 includes an upper portion 20 having an inner diameter that is greater than the inner diameter of housing bore lower portion 22. Housing bore upper portion 20 is concentric with the outer diameter of housing 12 and housing axis 25, and housing bore lower portion 22 is eccentric with housing axis 25. Thus, upper portion 20 has an axis that coincides with housing axis 25 and lower portion 22 has a housing lower portion axis 27 that is offset from and parallel to housing axis 25. Upward facing shoulder 30 delineates housing bore upper portion 20 from housing bore lower portion 22.

Cylindrical cam 40 is rotatably disposed within housing bore 18. Cam 40 includes an upper end 41. Although not shown, upper end 41 may include structure to facilitate attaching upper end 41 to a rotatable component (not shown) for rotating cam 40 relative to housing 12.

Various devices could be employed to cause relative rotation between cam 40 and housing 12. For example, a piston with a threaded portion may be in engagement with a mating threaded portion of cam 40. The piston could be located in housing 12 above cam 40 for sealing, axial movement, but not rotating movement. The operator would pump fluid through the string, which causes the piston to move downward, and the threaded portion would translate the downward movement of the piston into rotation of cam 40.

Alternately, relative rotation could be accomplished by rotating the string and housing 12 after cam 40 is in engagement with the stuck object or fish. The frictional engagement of cam 40 with the fish would prevent it from rotating while housing 12 is rotated.

Another mechanism for imparting relative rotation between cam 40 and housing 12 would be to set a rod (not shown) against the fish. The rod would thread into a nut set into tool 10 with a locking profile on the topside and a blank profile on the bottom, such that when the rod is pushed against the fish, the nut will set into the locking profile and rotate cam 40. When tool 10 is at the bottom of its stroke, it can be lifted up and the nut will fall out of the locking profile. The rod will need to be energized, such as with a spring, to stroke back out, such that when the tool is set down again it can repeat its original stoke and rotate cam 40 further. The entire tool can then be repeatedly stroked up and down until cam 40 grabs the fish.

Figure 1B:
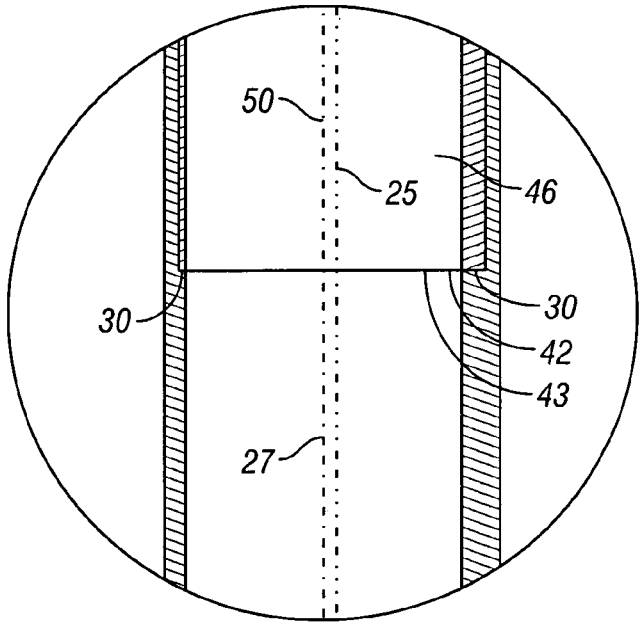
Figure 2:
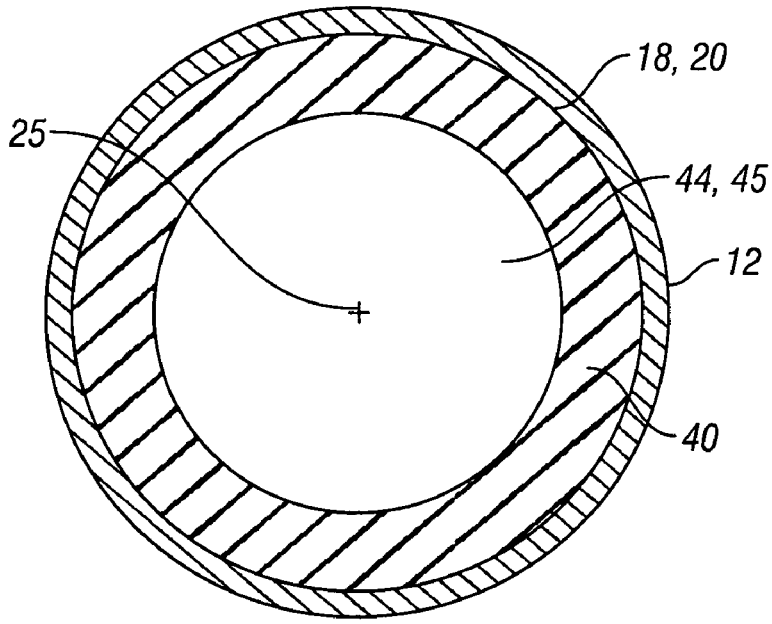
FIG. 2 is a cross-sectional view of the overshot tool of FIG. 1 taken along line 2-2.

Cam 40 also includes second end 42 having opening 43 in fluid communication with cam bore 44. Second end 42 contacts shoulder 30 of housing 12. Additionally, cam 40 is rotatably engaged with housing 12 and shoulder 30 in housing bore upper portion 20. As shown in FIG. 1, the exterior wall surface of cam 40 is engaged with the inner wall surface of housing bore upper portion 20. Additionally, second end 42 of cam 40 is engaged with shoulder 30.

Figure 3:
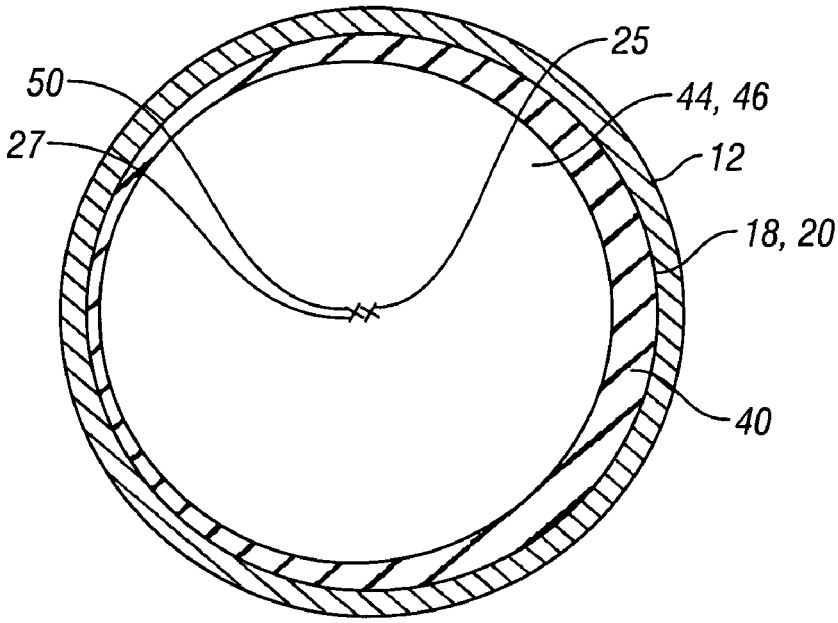
FIG. 3 is a cross-sectional view of the overshot tool of FIG. 1 taken along line 3-3.
Figure 4:
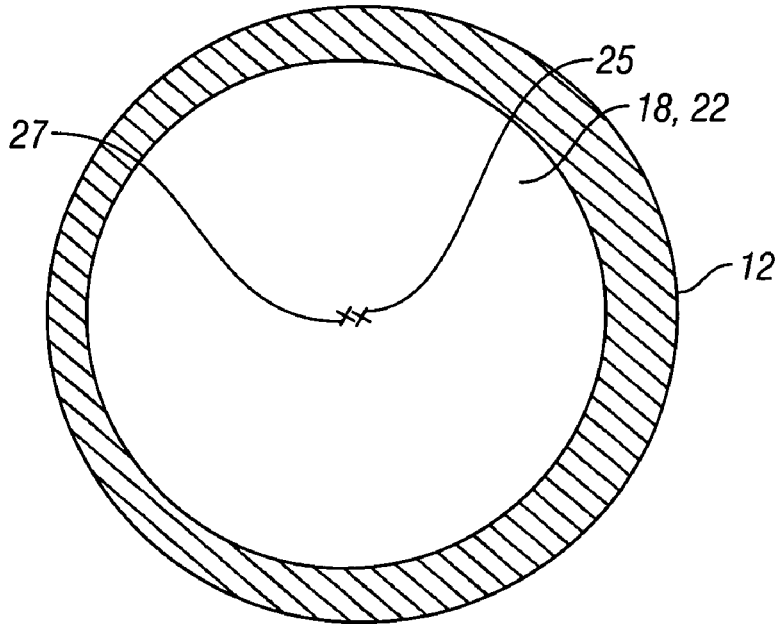
FIG. 4 is a cross-sectional view of the overshot tool of FIG. 1 taken along line 4-4.

Cam bore 44 includes cam bore upper portion 45 and cam bore lower portion 46, both of which are preferably cylindrical. In this example, the point at which cam bore upper portion 45 meets cam bore lower portion 46 is preferably conical or flared. Because in this example cam bore upper portion 45 is offset with cam bore lower portion, the flared connection between these two portions 45 and 46 has a height that varies from a minimum on one point, shown on the left right side of FIG. 1, to a maximum 180 degrees away from the minimum point. Additionally, cam bore upper portion 45 has an inner diameter that is less than an inner diameter of cam bore lower portion 46. Also, cam bore upper portion 45 is concentric with housing axis 25. Cam bore lower portion 46, however, is eccentric with housing axis 25. Thus, cam upper portion 45 has an axis that coincides with housing axis 25 and cam lower portion 46 has cam lower portion axis 50, which is offset and parallel to housing axis 25. The wall thickness of cam 40 at lower end 42 varies from a minimum point to a maximum point 180 degrees away. The amount of offset of cam bore lower portion axis 50 relative to housing axis 25 is the same as the offset of housing bore lower portion axis 27 to housing axis 25. Preferably the inner diameter of cam bore lower portion 46 is the same as the inner diameter of housing bore lower portion 22. As shown in FIGS. 1 and 3, in the unset position, cam lower portion axis 50 is aligned or coincides with housing bore lower portion axis 27. Housing bore lower portion 22 and cam bore lower portion 44 thus present a single diameter smooth bore extending from housing lower end 14 to cam bore upper portion 45 while aligned, as shown in FIG. 1. The aligned position facilitates sliding tool 10 over a fish (not shown) in a wellbore.

Figure 6:
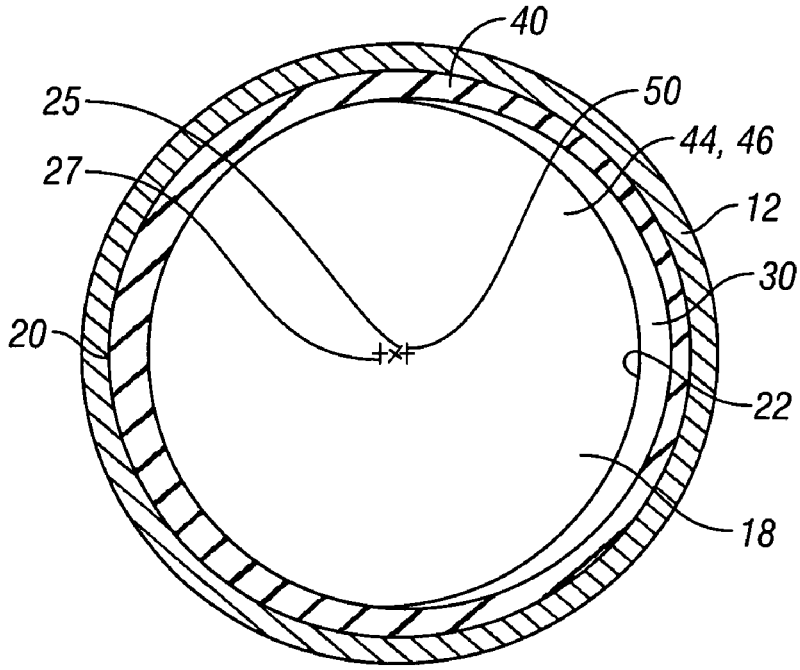
FIG. 6 is a cross-sectional view of the overshot tool shown in FIG. 5 taken along line 6-6.
Figure 5A:
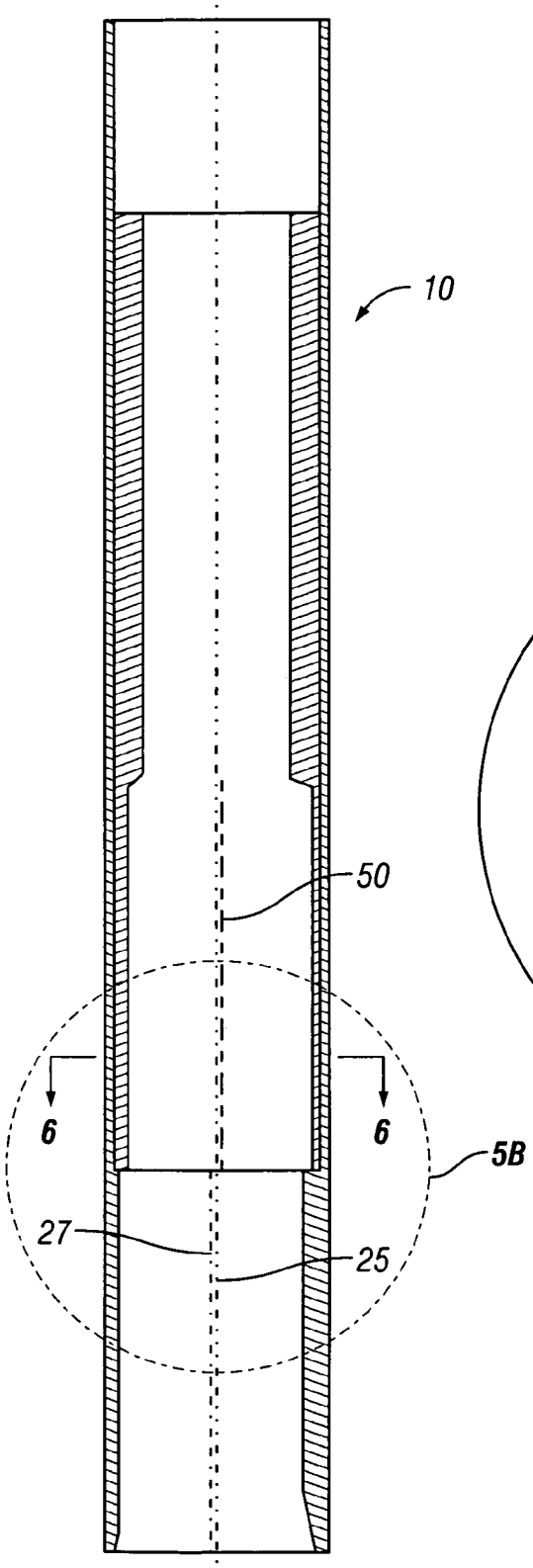
FIG. 5 is a vertical cross-sectional view of the overshot tool shown in FIG. 1 in its set position.
Figure 5B:
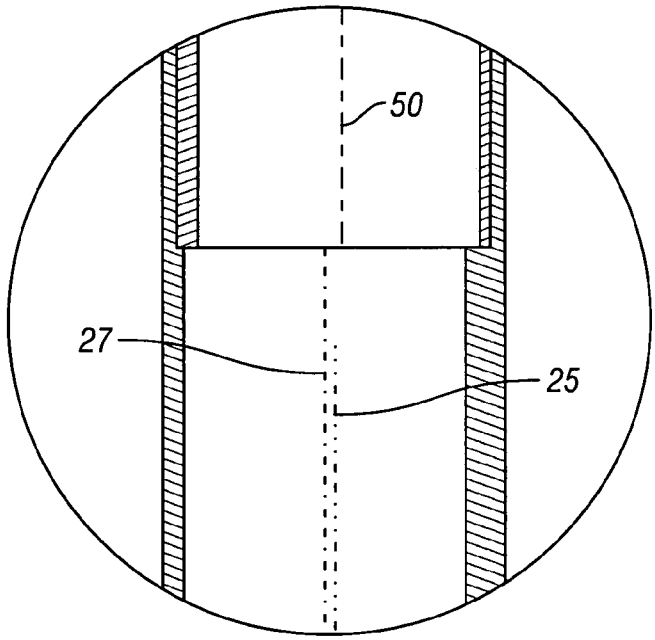

Referring now to FIGS. 5 and 6, overshot tool 10 is shown in a set position, i.e., a position in which overshot tool 10 has already slid over the fish (not shown) and has been positioned to grip or secure the fish. As illustrated in FIG. 5, cam 40 has been rotated 180 degrees relative to housing 12, resulting in the misalignment of cam lower portion axis 50 with housing lower portion axis 27. The fish extends through housing bore lower portion 22 and into cam bore lower bore portion 46. The rotation of cam 40 causes misalignment of bore portions 22 and 46, creating a bending moment on the fish. In FIG. 5, the rotation is a full 180 degrees, which places axis 27 and axis 50 on opposite sides from housing axis 25. Although FIG. 5 shows cam 40 rotated 180 degrees, it is to be understood that cam 40 may be rotated less than 180 degrees to grip the fish. As those skilled in the art will recognize, different types of fish will require different degrees of rotation. Additionally, those skilled in the art will also recognize that instead of cam 40 being rotated, housing 12 may also be rotated, or housing 12 may be rotated instead of cam 40 being rotated.

In one specific method of operation, overshot tool 10 is secured to a string (not shown). Overshot tool 10 is initially in its unset position (FIGS. 1-4), i.e., cam lower portion axis 50 is aligned with housing lower portion axis 27. Overshot tool 10 is then run into a well until the fish (not shown) is disposed within housing bore 18 and cam bore 44. Subsequently, cam 40 and/or housing 12 is rotated such that cam lower portion axis 50 is misaligned with housing lower portion axis 27, i.e., overshot tool 10 is placed in a misaligned, or set, position (FIGS. 5-6). The rotation of cam 40 relative to housing 12 may be any degree of rotation desired or necessary to secure the fish within housing bore 12 and cam bore 44. For example, cam 40 may be rotated 30 degrees, 60 degrees, 90 degrees, or 120 degrees relative to housing 12. As will be recognized by persons skilled in the art, the maximum degree or rotation of cam 40 relative to housing 12 to tighten the grip of cam 40 on the fish is 180 degrees. Rotation of more than 180 degrees would result in cam 40 loosening its grip on the fish.

Due to the misalignment of cam lower portion axis 50 with housing lower portion axis 27, the fish is gripped or secured within housing bore lower portion 22 and cam bore 44. Once the fish is secured, overshot tool 10, together with the fish, are retrieved from the well by raising or removing overshot tool 10 and the fish from the well.

It is to be understood that the invention is not limited to the exact details of construction, operation, exact materials, or embodiments shown and described, as modifications and equivalents will be apparent to one skilled in the art. For example, the interface between the housing and the cam can be helically-shaped. The helical shape would apply torque to the cam when the fish is pulled on so that the cam would grab tighter. This arrangement would also allow the tool to be set by compressing the cam into the body.

Additionally, the tool could be designed with the eccentric bore of the cam stepped with multiple inner diameter portions. Small fish that would not be grabbed by the camming mechanism of the largest inner diameter portion would fit farther into the tool to reach a smaller inner diameter portion. The additional inner diameter portions of the cam bore could share a common axis or be offset relative to each other.

One or more sleeves could be stacked and locked into place inside the eccentric bore of the cam body. A small fish would be guided into the sleeve or sleeves and the tool set with the fish in the sleeve. A large fish would enter the bore and push the sleeve up out of the way before the tool is set. Moreover, the housing and the cam may have a shape other than cylindrical. Additionally, the housing bore and the cam bore may be elliptically-shaped or have another non-circular shape desired or necessary to facilitate gripping the fish.

In still other modifications of the overshot tool, a collet or one or more collet fingers may be disposed within the cam bore with each collet finger being inwardly biased and pointing downward. In these embodiments, the fish would be positioned within the collet fingers, or between a single collet finger and the inner wall of the cam bore. In so doing, the collet finger or fingers would be expanded or moved outwardly as the fish is further inserted within a bore of the collet, or within the cam bore. The inwardly biased collet finger or fingers would provide additional force against the fish to help secure the fish within the cam prior to the cam being rotated.

As mentioned, the cam may be rotated relative to the housing, i.e., the cam is rotated and the housing is not rotated, or the housing may be rotated relative to the cam, i.e., the housing is rotated and the housing is not rotated. Alternatively, both the cam and the housing may be rotatable to facilitate gripping the fish. Moreover, the cam bore may only contain one axis, i.e., the cam upper portion inner diameter is equal to the cam lower portion inner diameter, provided that the cam axis can be rotated out of and into alignment with the housing lower portion axis.

Further, the shoulder between the housing bore upper portion and the housing bore lower portion may be a flange disposed at the opening of the housing bore lower portion. In other words, the housing bore lower portion is the opening. Additionally, the outer diameter of the cam may include a flange or shoulder that is slidingly engaged with the inner wall surface of the housing bore. The shoulder of the cam could be disposed anywhere along the length of the cam. The shoulder would then be rotatably engaged with the shoulder in the housing bore. As a result, in certain embodiments, the cam would not only be disposed within the housing bore upper portion, but would also be disposed within the housing bore lower portion.

Additionally, the housing bore may include a third portion disposed either above the housing bore upper portion or below the housing bore lower portion to more aggressively engage the fish or to facilitate the retrieval of differently sized fish. Accordingly, the invention is therefore to be limited only by the scope of the appended claims.

What is claimed is:

1. An overshot tool for retrieving an object in a well, the tool comprising:

a stationary housing having an upper end for attaching to a string for lowering the tool into the well, a housing bore having upper and lower portions, the lower portion having a lower portion inner wall surface defined by a lower portion inner diameter and a lower portion axis, the lower portion axis being defined relative to the lower portion inner wall surface;

a cam carried in the upper portion of the bore, the cam having a cam bore that has a lower cam bore portion comprising a lower portion cam bore inner wall surface defined by a lower portion cam bore inner diameter, the lower portion cam bore inner diameter being constant, and a cam bore axis, the cam bore axis being defined relative to the lower portion cam bore inner wall surface;

the cam being rotatable relative to the stationary housing from an aligned position wherein the cam bore axis and the lower portion axis coincide, to a misaligned position wherein the cam bore axis and the lower portion axis are offset and parallel to each other; and the lower portion of the housing bore and the cam bore being open at a lower end of the housing for sliding over an object in the well while the cam bore axis and lower portion axis are in the aligned position, so that subsequent rotation of the cam relative to the stationary housing causes the cam bore axis and the lower portion axis to move toward the misaligned position, thereby gripping the object for retrieval.

2. The tool of claim 1, wherein the upper portion of the housing bore has an upper portion inner diameter that is greater than the lower portion inner diameter.

3. The tool of claim 1, wherein the lower portion axis is offset and parallel to an upper portion axis of the upper portion of the housing bore, the upper portion axis being equidistant from an upper portion wall surface defined by an upper portion inner diameter.

4. The tool of claim 1, wherein the cam bore includes a cam upper portion that is concentric with the upper portion of the housing bore.

5. The tool of claim 1, wherein the upper portion of the housing bore comprises an upper portion inner wall surface defined by an upper portion inner diameter, and an upper portion axis, the upper portion axis being equidistant from the upper portion inner wall surface.

6. The tool of claim 1, wherein the lower portion inner diameter is substantially equal to the lower portion cam bore inner diameter.

7. The tool of claim 1, wherein the upper portion of the housing bore has an upper portion axis disposed equidistant from an upper portion inner wall surface defined by an upper portion inner diameter;

the lower portion axis is offset and parallel to the upper portion axis; and the cam bore axis is offset and parallel to the upper portion axis in both the aligned and misaligned positions.

8. The tool of claim 7, wherein in the misaligned position, the cam bore axis is spaced on a side of the upper portion axis that is 180 degrees from the lower portion axis.

9. The tool of claim 1, wherein the lower portion of the housing bore lower portion of the bore has a cylindrical exterior and a wall thickness that varies from a minimum thickness on one side to a maximum thickness on an opposite side.

10. The tool of claim 1, wherein the the upper portion of the housing bore has an upper portion axis defined relative to an upper portion inner wall surface defining an upper portion inner diameter, the upper portion inner diameter being larger than the lower portion inner diameter.

11. An overshot tool for retrieving an object in a well, the tool comprising:

a stationary housing having a string connection end, an open end, and a housing bore disposed longitudinally through the housing and in fluid communication with the open end, the housing bore having an upper concentric portion defined relative to an outer diameter of the housing, a lower eccentric portion having a bore eccentric portion inner diameter, the lower eccentric portion being defined relative to the outer diameter of the housing, and a shoulder delineating the upper concentric portion from the lower eccentric portion; and a rotatable cam disposed within the upper concentric portion of the housing bore and contacting the shoulder, the cam having an attachment end, a lower open end, and a cam bore disposed longitudinally through the cam, the cam bore having an eccentric cam bore portion having a cam bore eccentric portion inner diameter, the eccentric cam bore portion being defined relative to the outer diameter of the housing defining a cam bore eccentric portion inner wall surface and a cam bore eccentric portion axis, the cam bore eccentric portion inner diameter being constant along a longitudinal length of the cam bore, wherein the housing bore eccentric portion inner diameter is equal to the cam bore eccentric portion inner diameter.

12. The retrieval tool of claim 11, wherein the upper concentric portion inner diameter is greater than the lower eccentric portion inner diameter.

13. The retrieval tool of claim 11, wherein the eccentric cam bore portion is cylindrical and surrounded by an exterior portion of the cam that is cylindrical but offset relative to the eccentric cam bore portion.

14. The retrieval tool of claim 11, wherein the cam bore further includes a concentric cam bore portion defined relative to an outer diameter of the cam.

15. The retrieval tool of claim 14, wherein the concentric cam bore portion is disposed above the eccentric cam bore portion.

16. The retrieval tool of claim 11, wherein rotating the cam relative to the housing causes the eccentric cam bore portion to move from aligned to misaligned positions with the lower eccentric portion of the housing bore.

17. A method of retrieving a fish disposed in a bore of a well, the method comprising the steps of:

(a) running an overshot tool into a well, the overshot tool comprising a cam carried within a stationary housing, the cam and stationary housing each having a bore portion with an axis defined by respective inner wall diameters defining respective inner wall surfaces, the axes being equidistant from the respective inner wall surfaces, the cam being rotatable relative to the stationary housing from an aligned position wherein axes of the bore positions coincide to a misaligned position wherein the axes of the bore portions are parallel and offset from each other;

(b) lowering the cam bore portion and housing bore portion over the fish while the cam bore portion and housing bore portion are in the aligned position;

(c) rotating the cam relative to the stationary housing to move the bore portions toward the misaligned position to secure the fish within the bore portions; then (d) removing the overshot tool and the fish from the bore of the well.

18. The method of claim 17, wherein the cam and the housing are rotated at least 60 degrees relative to each other between the aligned and the misaligned positions.

19. The method of claim 17, wherein the cam and the housing are rotated at least 120 degrees relative to each other between the aligned and the misaligned positions.

20. The retrieval tool of claim 14, wherein the concentric cam bore portion includes a cam bore concentric portion inner diameter, and the cam bore concentric portion inner diameter is less that the cam bore eccentric portion inner diameter.

* * * * *